US008202127B2

(12) United States Patent
Zhang et al.

(10) Patent No.: US 8,202,127 B2
(45) Date of Patent: Jun. 19, 2012

(54) ELECTRICAL CONNECTORS FOR STORAGE DEVICE

(75) Inventors: George Huanyi Zhang, Irvine, CA (US); Gustavo F Duenas, Placentia, CA (US); Bin Pan, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/891,824

(22) Filed: Sep. 28, 2010

(65) Prior Publication Data

US 2012/0077389 A1 Mar. 29, 2012

(51) Int. Cl.
*H01R 24/00* (2006.01)

(52) U.S. Cl. ..... 439/660

(58) Field of Classification Search ..... 439/660, 439/638, 637, 579, 188, 79
See application file for complete search history.

(56) References Cited

U.S. PATENT DOCUMENTS 6,942,524 B2 9/2005 Wu
7,497,709 B1 * 3/2009 Zhang ..... 439/188
7,572,130 B1 * 8/2009 Zhang ..... 439/79
7,909,652 B2 * 3/2011 Yang et al. ..... 439/660
2010/0105249 A1 * 4/2010 Bandhu et al. ..... 439/638

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector includes an insulated housing and a plurality of contact loaded in the insulated housing. The insulated housing defines an uninterrupted longitudinal slot extending in a first direction and through a mating face in a second direction perpendicular to the first direction the slot having a first and a second inner side faces facing to each other. The first inner side defines a groove extending through the mating face in the second direction. Each contacts includes a retaining portion retained in the insulated housing, a contacting portion exposing in the slot and a tail portion. The contacting portions defines a mating orientation along which the contacting portions contact with corresponding contacts of a counter electrical connector intended to be inserted in the slot. The plurality of contacts includes a first group and a second group of contacts lined along the first side face of the slot at opposite sides of the groove, and a third group, a forth group and a fifth group of contacts lined along the second side face. The third group of contacts are aligned with the groove, the forth group of contacts faces to the first group of contacts and the fifth group of contacts faces to the second group of contacts in a third direction perpendicular to the first and second directions.

15 Claims, 6 Drawing Sheets

ELECTRICAL CONNECTORS FOR STORAGE DEVICE

BACKGROUND OF THE INVENTION

1. Field of the Invention

The present invention generally relates to an electrical connector, and more particularly to an electrical connector providing an interface for a high speed storage device.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. So, we wish to design an electrical connector to overcome those problems.

SUMMARY OF THE INVENTION

Accordingly, an object of the present invention is to provide electrical connectors with more contacts adapted for higher transfer speed.

In order to achieve the object set forth, an electrical connector providing an interface for storage device comprises an insulated housing and a plurality of contact loaded in the insulated housing. The insulated housing defines an uninterrupted longitudinal slot extending in a first direction and through a mating face in a second direction perpendicular to the first direction the slot having a first and a second inner side faces facing to each other. The first inner side defines a groove extending through the mating face in the second direction. Each contact comprises a retaining portion retained in the insulated housing, a contacting portion exposing in the slot and a tail portion. The contacting portions defines a mating orientation along which the contacting portions contact with corresponding contacts of a counter electrical connector intended to be inserted in the slot. The plurality of contacts comprises a first group and a second group of contacts lined along the first side face of the slot at opposite sides of the groove, and a third group, a forth group and a fifth group of contacts lined along the second side face. The third group of contacts are aligned with the groove, the forth group of contacts faces to the first group of contacts and the fifth group of contacts faces to the second group of contacts in a third direction perpendicular to the first and second directions.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
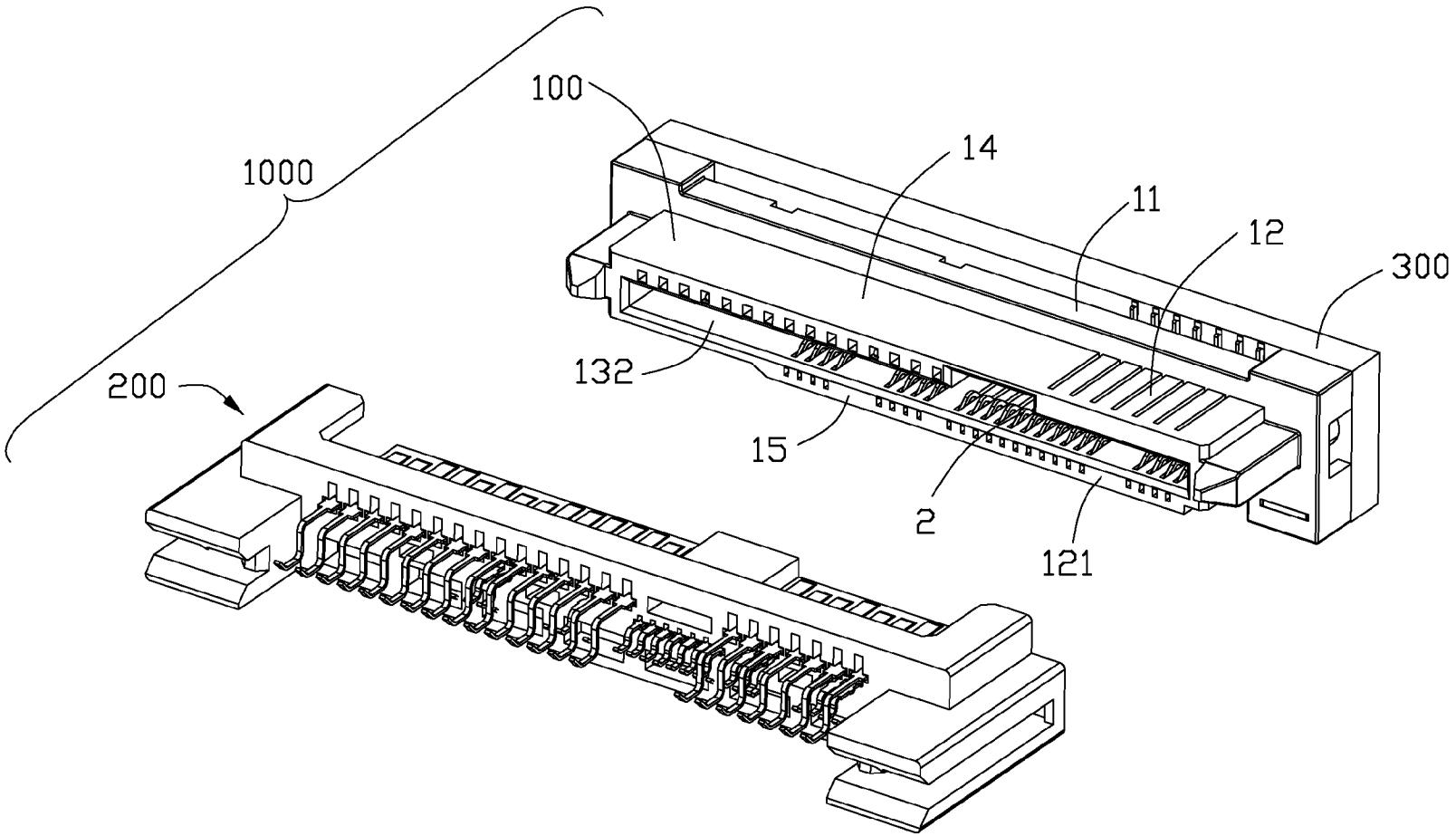
FIG. 1 is a perspective view of an electrical assembly in accordance with the present invention, the electrical assembly including a first electrical connector and a second mating electrical connector.
Figure 2:
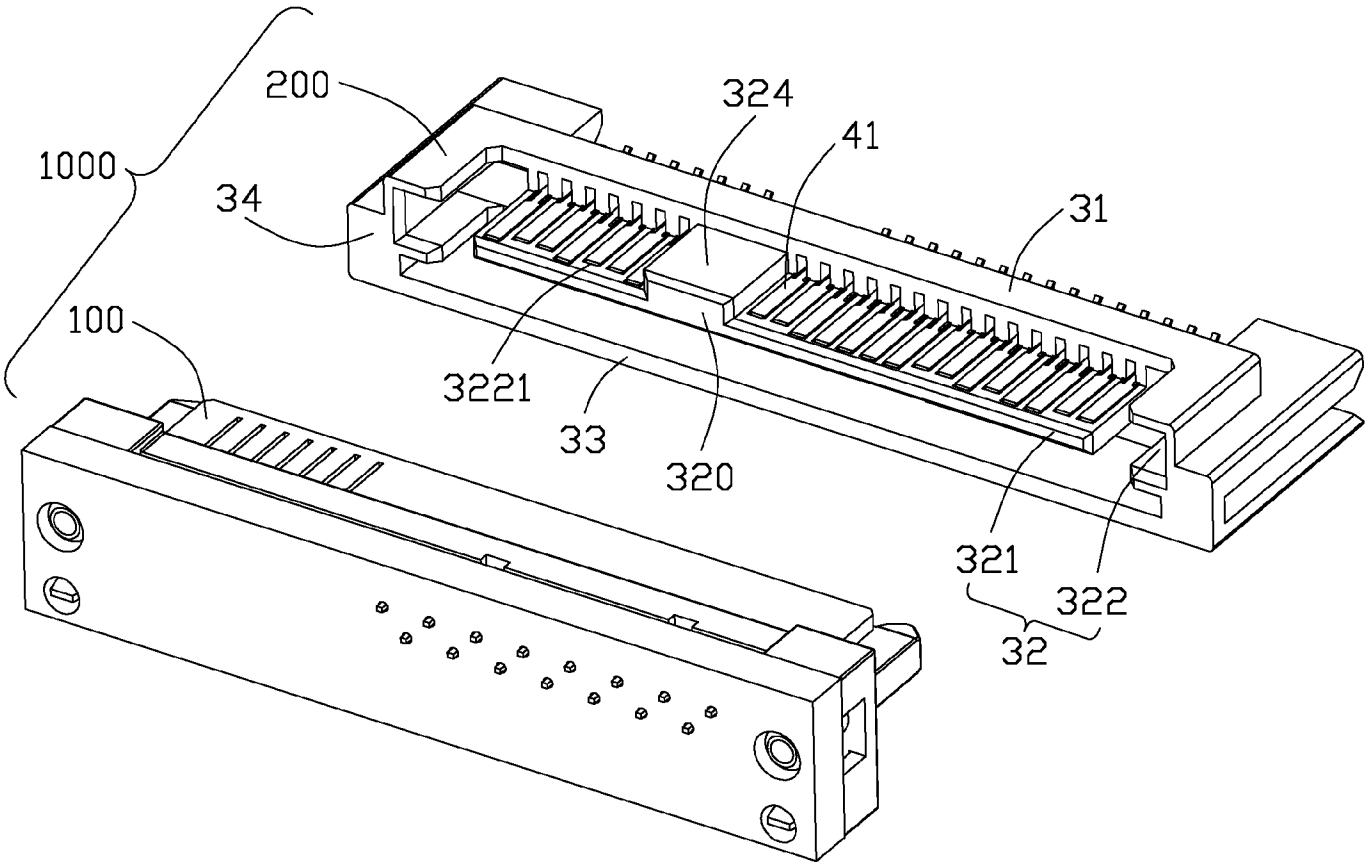
FIG. 2 is a view similar to FIG. 1 from a different aspect.

Referring to FIGS. 1 and 2, an electrical connector assembly 1000 including a first electrical connector 100 vertically mounted on a first circuit board 300 and a second electrical connector 200 right-angle mounted on a second circuit board (not shown), is illustrated. The electrical connectors 100, 200 are used for providing interfaces for a storage device, especially for SAS signal transmission.

Figure 3:
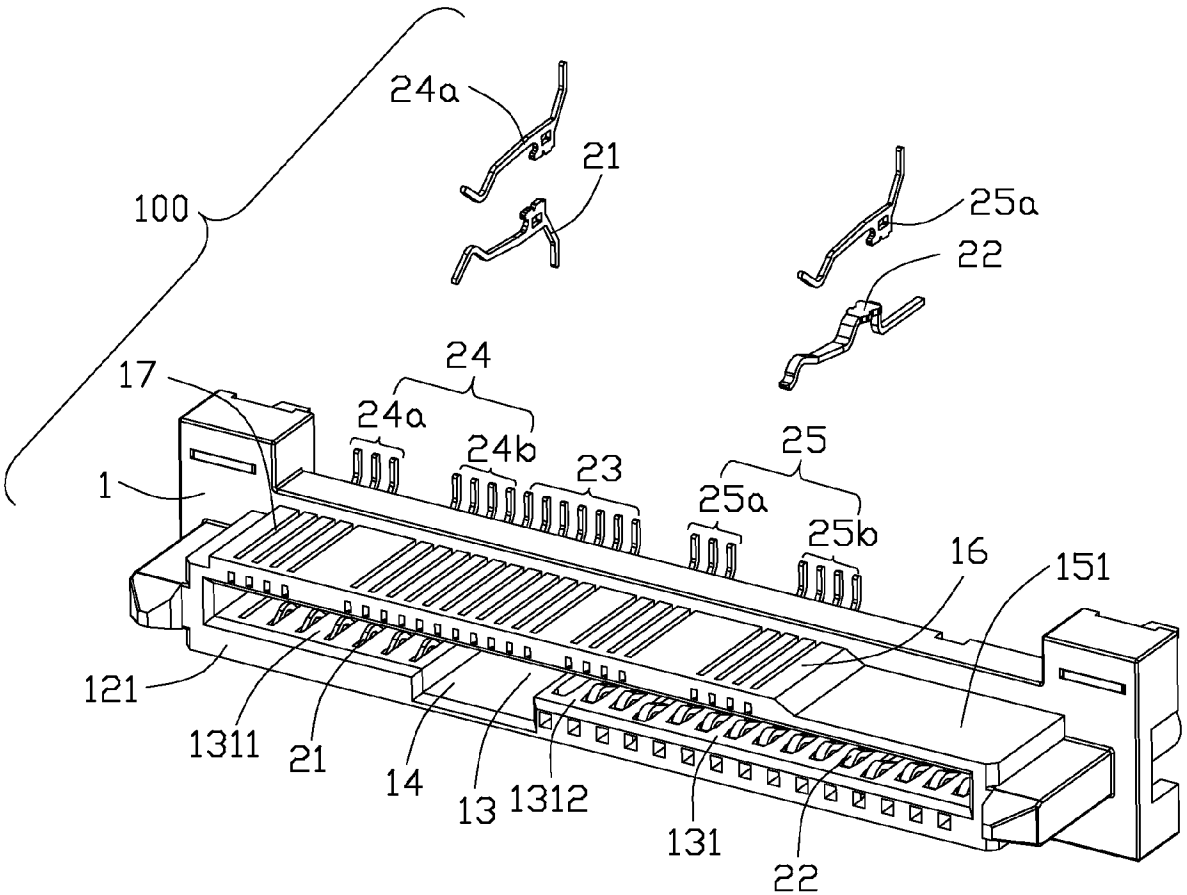
FIG. 3 is an exploded perspective view of the first electrical connector.

Referring to FIGS. 1 and 3 combination with FIG. 1, the first electrical connector 100 comprises an insulated housing 1 including a base portion 11 and a mating portion 12 projecting from a top face of the base portion, and a plurality of contacts 2 assembled to the insulated housing 10. The insulated housing 1 defines a mating face 121 at a top face of the mating portion 12 and a longitudinal uninterrupted slot 13 extending in a first direction and a second direction through the front face 121 and surrounded by two parallel sidewalls 14, 15. The slot 13 has a first inner side faces 131 and a second inner side faces 132 both extending from the mating face 121 to the inner face (i.e. the top face) of the base portion 11 in the second direction and facing to each other. One row of said contacts 2 is lined along the inner side faces, and each of said contacts extend along the first direction for mating with the second electrical connector 200. The first inner side face 131 of said slot 13 further defines a groove 14 extending from the mating face 12 in the second direction to the inner face of base portion 11, said groove 14 dividing the first inner face 131 into two areas named as a first area 1311, a second area 1312 longer than the first area in the first direction since the second area is load fifteen contacts. Corresponding, the contacts 2 in the first side face are divided to two groups named in turn as a first group 21 and a second group 22.

The first group 21 of the contacts in the first area 1311 is composed of seven contacts used for delivering signal which are named as S1-S7 defined in SAS 2.0 Specification. The second group 22 of the contacts is composed of fifteen contacts used for delivering power which are named as P1-P15 defined in SAS 2.0 Specification. The groove 14 has no contacts therein.

Figure 4:
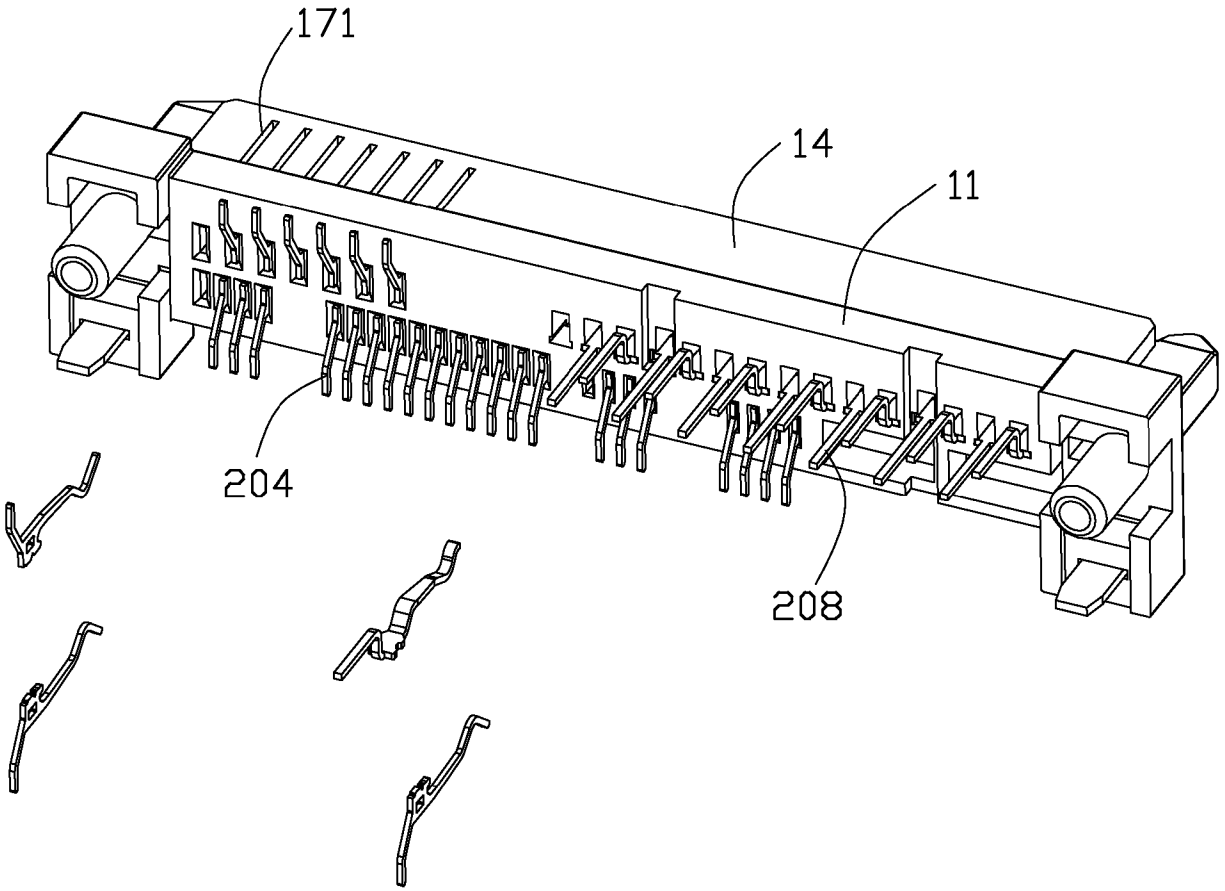
FIG. 4 is a view similar to FIG. 3 from a different aspect.

The second inner side face 132 is in a same plane without any grooves. The second sidewall 15 is thinner than the first sidewall 14 except an uninterrupted expanding portion 16 defined at an outer side face 151 of the second sidewall 15, which extends from the top face the base portion to the mating face 121 of the mating portion 12 in the second direction and extend from left side of the second sidewall 15 but not arrive to the right side of the second sidewall 15, i.e., the expanding portion 16 is aligned with the first rear 1311 and portion of the second area 1312 adjacent to the groove 14. The expanding portion 16 is used for disposition another row of said contacts 2. A third group of contacts 23 composed of seven contacts used for delivering signal which are named as S8-S14 defined in SAS 2.0 Specification, is disposed aligned with the groove 14 in a third direction perpendicular to the first and second direction. A forth group of contacts 24 composed eight contacts and a fifth group of contacts 25 composed of eight contacts are added at opposite sides of the third group of contacts 23 (two contacts 24*a*, 25*a* are draw out from the housing in FIGS. 3 and 4). The contacts of said forth and fifth groups are arranged in the S-S-G-S-S-G-S-S pattern, which both are used for deliver signals.

The second sidewall 15 defines corresponding numbers of passageways 17 therein, which penetrate through the inner side face 132 and the outer side face 151 thereof to receive the third to fifth groups of contacts. The forth group of contacts 24 are divided to two sub-groups 24*a*, 24*b* and the fifth group 25 is also divided to two sub-groups 25*a*, 25*b*. The contacts in a same group or a same subgroup have a same contact distance between every adjacent contacts. The second sub-group 24*b* is located beside the third group 23 with the contact pitch and the first sub-group 24*a* spaces from the first sub-group 24*a* with a large subgroups distance L1. The first sub-group 25*a* is located beside the third group 23 with a groups distance L2 and the second sub-group 25*b* spaces from the first sub-group 25*a* with a subgroups distance L3. The distance L3 equals to the distance L1 and is larger than the distance L2. Since the second sub-group 24*b* is arranged beside the third group 23 with a contact distance, the second sub-group 24*b* is commonly configured as a unit apparently. Please notes the group division should consider the transmission type of connector.

Figure 5:
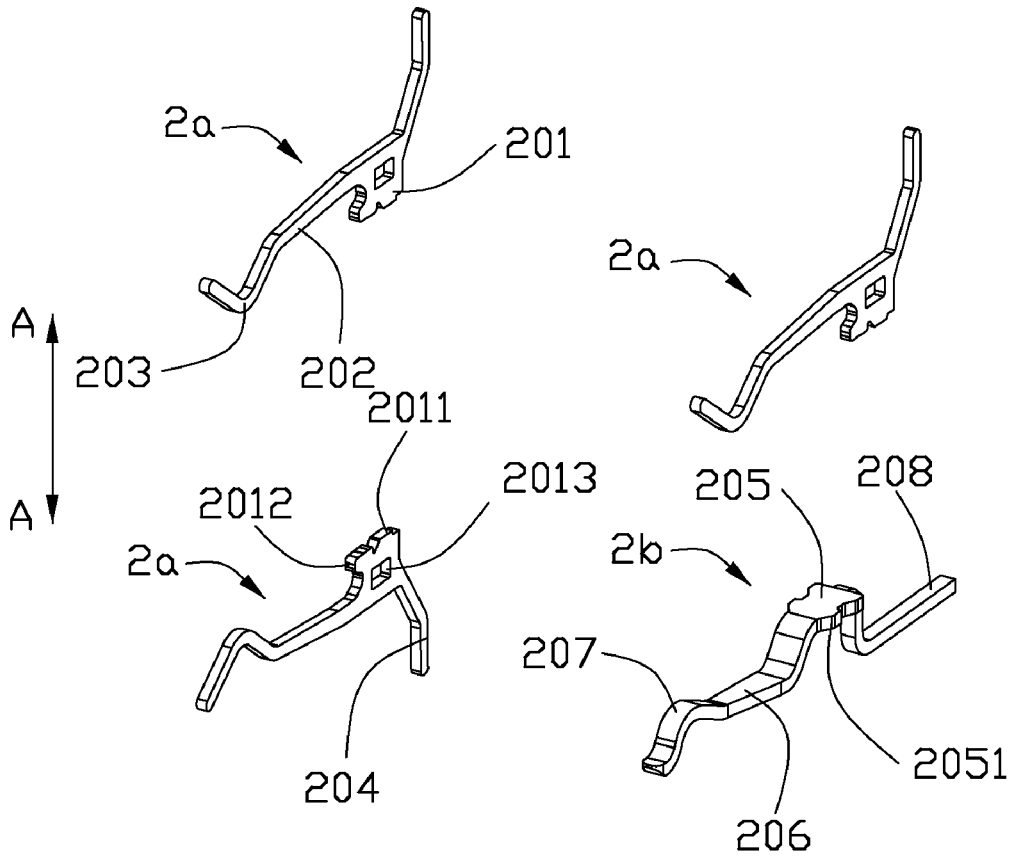
FIG. 5 is a perspective view of four contacts.
Figure 6:
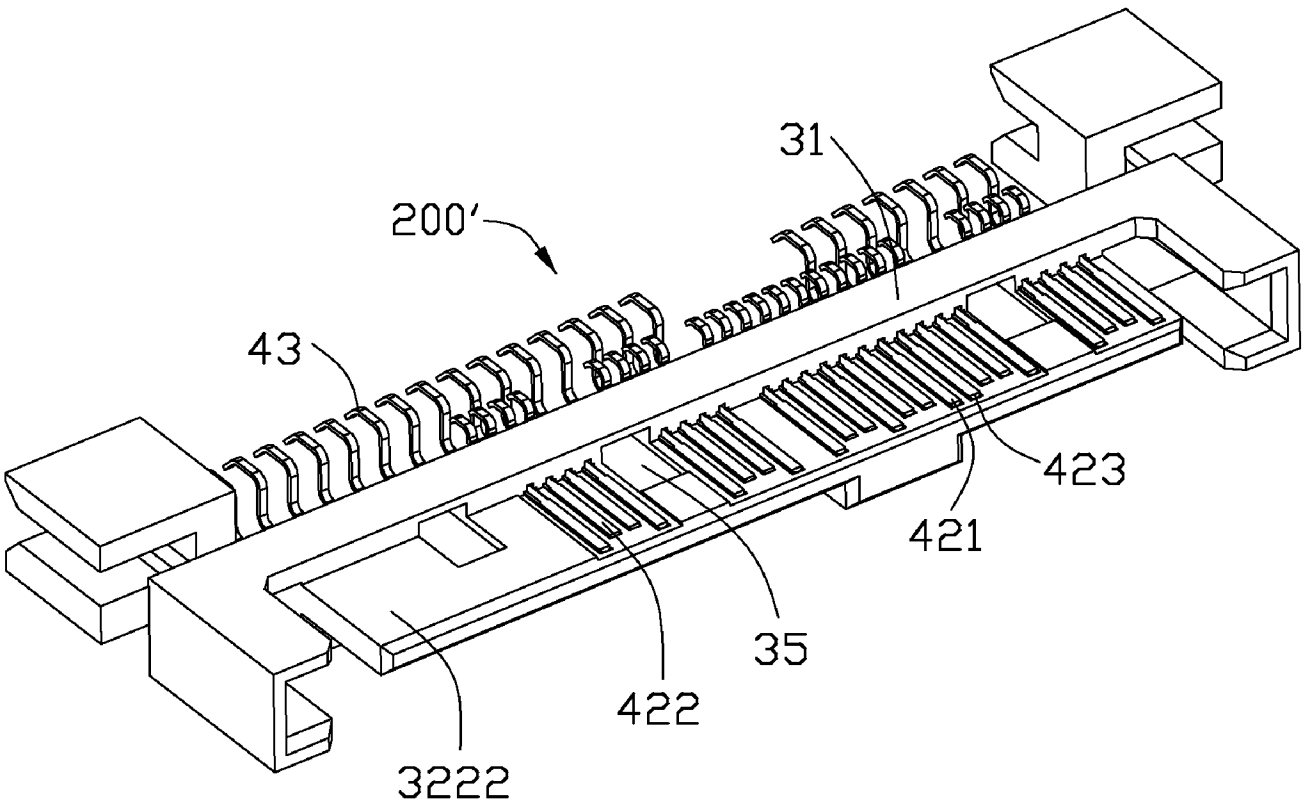
FIG. 6 is a perspective view of a second connector varied from the second connector shown in FIG. 2.

Referring to FIG. 6, the contacts in every group have a same configure. The contacts in third, forth and fifth groups 23, 24, 25 have a same shape, the first group of contacts is arranged mirror to the forth group of contacts 24. So the same contacts are only introduced one time. Combination with FIG. 5, the contact 2*a* in the first, third, forth and fifth groups is of a vertical type by cutting a metal sheet and includes a board retaining portion 201 with barbs 2011, 2012, an elastic arm 202 with an inward-converted contacting portion 203 at a freed end thereof and a tail portion 204 extending opposite to the projection direction of the contacting portion 203. The elastic portion 202 and the tail portion 204 extend from opposite lateral sides of the retaining portion 201. The contact 2*a* is formed by cutting in the metal sheet, i.e., the contacting portion 203 is formed at a cutting face of the metal sheet and the barbs 2011, 2012 extend from the cutting face. The contacting portion 203 defines a mating or elastic enforce orientation shown in double arrow A-A which is parallel to the retaining portion 201. The retaining portion 201 has an open 2013 in a centre thereof which not only adjusts matching impedance but also interlocks with housing for securing (not shown).

The contact 2*b* in the second group 22 is of a horizontal type which is made by cutting and bending a metal sheet, which includes a retaining portion 205 with barbs 2051 at opposite lateral sides of the retaining portion, an elastic arm 206 with an inward-converted contacting portion 207 at a freed end thereof and the tail portion 208. The elastic arm 206 and the tail portion 208 extend from opposite ends of the retaining portion 205. The contacting portion 207 also a mating orientation parallel to the mating orientation A-A. Since contacts 2 are mated with the second connector 200 through the slot 13, the mating orientation of all contacts is common defined along the A-A orientation. The retaining portions 205 of the contacts 2*b* are perpendicular to the mating orientation and the contacting portions 207 are formed in metal sheet plane not the cutting face.

When the first connector 100 is used in high speed device, the vertical type contacts can reduce the contact distance between every adjacent contacts, which will reduce the cross-talk produced by the contacts. The passageways 17 penetrating through the outer side face 151 also benefit reduce of the cross talk. The second group 22 of the contacts is still in horizontal type to obtain a wider dimension to ensure power transmission security. Please referring to FIG. 4, the passageways 171 in the first sidewall 14 also penetrate through an outer side face of the first sidewall 14 also benefit the cross-talk reduce. The tail portions 204, 208 of the contacts 2 expose to a rear face of the base portion 11. The tail portions 204 of the vertical contacts 2*a* are in a surface mounting type and the tail portion 208 of the horizontal contacts 2*b* are in a vertical through hole type.

Referring to FIG. 2, the second electrical connector 200 intended to mate with the first electrical connector 100, include a base portion 31 and a mating portion 32 which is formed by a tongue portion 321 and a pair of guiding portions 322 of an inverted U shape commonly extending from the base portion 31. A side wall 33 spaced parallel to the tongue portion 321 is located at one side of the tongue portion and unitarily connecting two end walls 34 of the connector. The tongue portion 321 defines a rib 324 at a first surface 3221 thereof unitarily extending forwards from the base portion to a front mating face 320, the rib 324 divides the first surface 3221 to two sections, one being larger than the other section.

A plurality of contacts 41 is located in the first surface 3221 to mate with the first and second groups of contacts of the first electrical connector 100. Furthermore, a second surface of the tongue portion 32 opposite to the second surface is arranged with a plurality of contact. Since the configuration of the second surface is unseen blocking by the side wall 33 in FIG. 2, a variation of the second connector 200' is shown in FIG. 6 to fully show the second surface 3222. The contacts on the second surface are also divided to three groups 421, 422, 423 to mate with the third, forth and fifth groups of contacts of the first electrical connector 100. The groups 422, 423 are divided to two sub-groups respectively, the two sub-groups of each group space away with a large distance where defines a recess 35 running through the base portion 31 in the second direction. All contacts in the second connector have surface mounting tail portions 43.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector providing an interface for storage device, comprising:

an insulated housing defining an uninterrupted longitudinal slot extending in a first direction and through a mating face in a second direction perpendicular to the first direction the slot having a first and a second inner side faces facing to each other, the first inner side defining a groove extending through the mating face in the second direction;

a plurality of contact loaded in the insulated housing and each comprising a retaining portion retained in the insulated housing, a contacting portion exposing in the slot and a tail portion, the contacting portions defining a mating orientation along which the contacting portions contact with corresponding contacts of a counter electrical connector intended to be inserted in the slot;

the plurality of contacts comprising a first group and a second group of contacts lined along the first side face of the slot at opposite sides of the groove, and a third group, a forth group and a fifth group of contacts lined along the second side face;

wherein the third group of contacts are aligned with the groove, the forth group of contacts faces to the first group of contacts and the fifth group of contacts faces to the second group of contacts in a third direction perpendicular to the first and second directions.

2. The electrical connector as claimed in claim 1, wherein the slot is surrounded by opposite first and second sidewalls, the second sidewall defines an uninterrupted expanding portion at an outer side face opposite to the second inner side face to load said third, forth and fifth group of contacts.

3. The electrical connector as claimed in claim 1, wherein the forth group and the fifth group of contacts are divided to two subgroups respectively, every adjacent sub-groups spaces from each other with a subgroup distance larger than a contact distance between every adjacent contacts of a same group or sub-group of contacts.

4. The electrical connector as claimed in claim 3, wherein one sub-group of said two groups of the forth group adjacent to the third group of contacts spaces from the third group with a groups distance larger than the contact distance while one subgroup of said two group of the fifth group is located beside the third group of contacts spaced with the contact distance.

5. The electrical connector as claimed in claim 4, wherein contacts of the first group, the third group, the forth group and the fifth group are of vertical type and the retaining portions of said four group are parallel to the mating orientation, while the contacts of the second group are of horizontal type and the retaining portions of the second group are perpendicular to the mating orientation.

6. The electrical connector as claimed in claim 5, wherein passageways defined on the sidewalls to receive the first group, the third group, the forth group and the fifth group of contacts penetrate through the outer side faces of the sidewalls.

7. The electrical connector as claimed in claim 5, wherein retaining portion of said four groups has an open.

8. An electrical connector assembly comprising:

an elongated insulative housing defining a lengthwise direction with an elongated slot extending along the lengthwise direction and located between opposite first and second elongated side walls in a lateral direction perpendicular to said lengthwise direction, said first side wall being thicker than the second side wall and defining a groove inwardly communicating with the elongated slot in the lateral direction;

a first set of resilient contacts disposed in the first side walls and by two sides of said groove in said lengthwise direction with a large pitch thereof; and a second set of resilient contacts disposed in the second side wall with a small pitch thereof; wherein some of the second set of resilient contacts face toward the groove in said lateral direction; wherein the second side wall defines first and second areas under condition that the first area being equipped with said second set of resilient contacts is thicker than the second area without the second set of resilient contacts equipped therewith.

9. An electrical connector assembly comprising:

an elongated insulative housing defining a lengthwise direction with an elongated slot extending along the lengthwise direction and located between opposite first and second elongated side walls in a lateral direction perpendicular to said lengthwise direction, said first side wall being thicker than the second side wall and defining a groove inwardly communicating with the elongated slot in the lateral direction;

a first set of resilient contacts disposed in the first side walls and by two sides of said groove in said lengthwise direction with a large pitch thereof; and a second set of resilient contacts disposed in the second side wall with a small pitch thereof; wherein some of the second set of resilient contacts face toward the groove in said lateral direction; wherein the second set of resilient contacts are of a blanking type defining a thickness direction parallel to said lengthwise direction while some of the first set of resilient contacts are of a forming type defining a thickness direction perpendicular to the lengthwise direction.

10. The electrical connector assembly as claimed in claim 9, wherein the second side wall defines a plurality of passageways to receive the corresponding second set of resilient contacts, and said passageways outwardly communicate with an exterior in said lateral direction.

11. The electrical connector assembly as claimed in claim 9, wherein the contacts of the blanking type own surface mounting tails while the contacts of the forming type own through hole tails.

12. The electrical connector assembly as claimed in claim 9, further including another insulative housing with a mating tongue received in the elongated slot, said another housing being equipped with a plurality of terminals mated with said first of resilient contacts and said second set of resilient contacts under condition that all said terminals are of the forming type.

13. The electrical connector assembly as claimed in claim 12, wherein said another housing defines an elongated side wall which cooperates with the mating tongue to sandwich the second elongated side wall therebetween in said lateral direction while leaving the first elongated side wall to be outwardly exposed to an exterior in said lateral direction.

14. The electrical connector assembly as claimed in claim 13, wherein said mating tongue defines a rib structure received in the groove.

15. An electrical connector assembly comprising:

an elongated insulative housing defining a lengthwise direction with a mating tongue with opposite first and second faces thereon in a vertical direction perpendicular to said lengthwise direction;

a first set of contacts disposed upon the first face and essentially arranged along the whole first face in said lengthwise direction except a rib structure which is located close to a middle region of the first face and divides said first set of contacts with two groups; and a second set of contacts disposed upon the second face and densely arranged essentially on a primary area on said second face while leaving a secondary area aside vacant under condition that the primary area and the secondary area commonly forms said second face; wherein the first set of contacts are located above the second set of contacts, tail sections of the first set of contacts are longer than those of the second set of contacts, and a first pitch of the first set of contacts is larger than a second pitch of the second set of contacts; wherein the rib structure is opposite to the primary area, and the second set of contacts are densely located upon an opposite corresponding region with respect to the rib structure under condition that a distance between every adjacent two second set of contacts is exactly same with the second pitch; wherein a contacting section of each of said first set of contacts is wider than that of each of said second set of contacts; wherein the second set of contacts are divided into four groups of different pairs along said lengthwise direction, under condition that each group is spaced from the neighboring group with a distance more than two times of said second pitch.

* * * * *